United States Patent [19]

Caruso

[11] Patent Number: 4,502,030

[45] Date of Patent: Feb. 26, 1985

[54] HIGH RELIABILITY SOLENOID SWITCH

[75] Inventor: Peter J. Caruso, Wayne, N.J.

[73] Assignee: Allied Corporation, Morris Township, Morris County, N.J.

[21] Appl. No.: 526,850

[22] Filed: Aug. 26, 1983

[51] Int. Cl.[3] ..... H01H 9/20

[52] U.S. Cl. ..... 335/164; 335/184; 335/123; 200/42 A

[58] Field of Search ..... 335/113, 119, 120, 123, 335/136, 164, 168, 184, 186, 140; 200/42 R, 42 A, 44, 5 B

[56] References Cited

U.S. PATENT DOCUMENTS

| | | | |
|---|---|---|---|
| 1,789,275 | 1/1931 | Howe | 335/184 |
| 3,223,802 | 12/1965 | Horst | 335/184 |
| 3,605,050 | 9/1971 | Goldman | 335/164 |

*Primary Examiner*—E. A. Goldberg
*Assistant Examiner*—George Andrews
*Attorney, Agent, or Firm*—Stanley N. Protigal

[57] ABSTRACT

A fail-safe solenoid switching mechanism (11) includes separate solenoids (17,18) for switchings to "armed" and "safed" statuses. A manually operated safing mechanism (19) has a capability of overriding the solenoids (17,18) to establish the switching mechanism (11) in the "safed" status. The manually operated safing mechanism (19) is operated by a special tool (41), which is retained by the switching mechanism (11) whenever the manually operated safing mechanism (19) is engaged. The manually operated safing mechanism (19) is held in engagement by a catch (22) whenever the solenoid (17) for arming is powered, thereby preventing the specialized tool from being removed and the switching mechanism (11) from inadvertently switching to the "armed" status. Further status indications are provided by a flag (54) which can be used to directly read the status of the switching assembly (11).

The switching assembly (11) uses a reciprocating switch (15) to establish make-or-break connections. In order to increase the effective life of shorting bars on the reciprocating part of the switch, the reciprocating part is rotated by a ratcheting mechanism each time the switch (15) is cycled.

Advantages include enhanced reliability, and positive assurances as to the operating status of the switching assembly.

8 Claims, 4 Drawing Figures

HIGH RELIABILITY SOLENOID SWITCH

BACKGROUND OF THE INVENTION

This invention relates to electrical switches and more particularly to electrical solenoid switches in which a switch operator is caused to move by electromagnetic coils in order to make or break a circuit. In particular, the present invention relates to a solenoid switch which is positively actuated in two directions by a solenoid arrangement and has a capability of manual operation in one direction.

In certain switch applications, it is necessary that assurances be had that equipment containing a switch not be used unless such use is indicated. It may be further important that the switch be tamper proof to the extent that unauthorized personnel cannot turn the equipment on and, when the equipment has been turned on, the equipment cannot be turned off except under certain circumstances. It is also desired that a switch be able to be manually set at and locked into an "off" position, with a visual indication of the locked "off" condition being present. In addition to the indication of the locked "off" position, it is important that a visual indication of the switched state of the switch be provided. For example, if personnel are working in an area where inadvertant operation of the equipment is hazardous, positive assurances of "safing" must be had.

In enhancing the reliability of such switch units, it is important that the switch be able to be operated reliably for a large number of cycles without preventative maintenance. The switch must have arc suppression capabilities. The use of an arc suppression circuit must be avoided because of the possibility that circuit elements within the arc suppression circuit can fail either on their own or with the aid of tampering. Arcing and other contact wear factors become more significant when high current levels, such as 50 amperes, are switched. The effects of pitting and other types of wear on the contact surfaces must also be minimized. Furthermore, these arc suppression problems become magnified in outer space environments in which a vacuum is present.

In further enhancing the reliability of switching, it is important that other switch malfunctions, such as contact bounce and undesired switching be eliminated. This becomes difficult when the switch becomes subjected to external forces, such as forces of acceleration and shock forces.

SUMMARY OF THE INVENTION

In accordance with the present invention, a slide switch is connected by levers to a pair of electromagnetic actuators. Each electromagnetic actuator is used for respectively opening or closing the switch. The lever system also has a provision for safing the switch into an "off" position by means of manual actuation. Manual actuation requires that a special tool which is inserted be retained in the switch housing so that the switch does not remain safed without a visual indication of the safed condition.

The slide switch itself includes a cylindrical armature having shorting rings on its surface and a plurality of stator beam contacts extend about the armature and are biased against the armature. A ratchet mechanism associated with one of the actuator levers causes the armature to rotate when the switch is operated in one direction. This rotation ensures that wear on contacting members of the armature is evenly distributed about the armature.

Advantages include long contact life and assurance of positive switching function. The present invention permits high current levels to be switched from a relatively small assembly.

DETAILED DESCRIPTION OF THE PREFERRED EMBODIMENT

Figure 1:
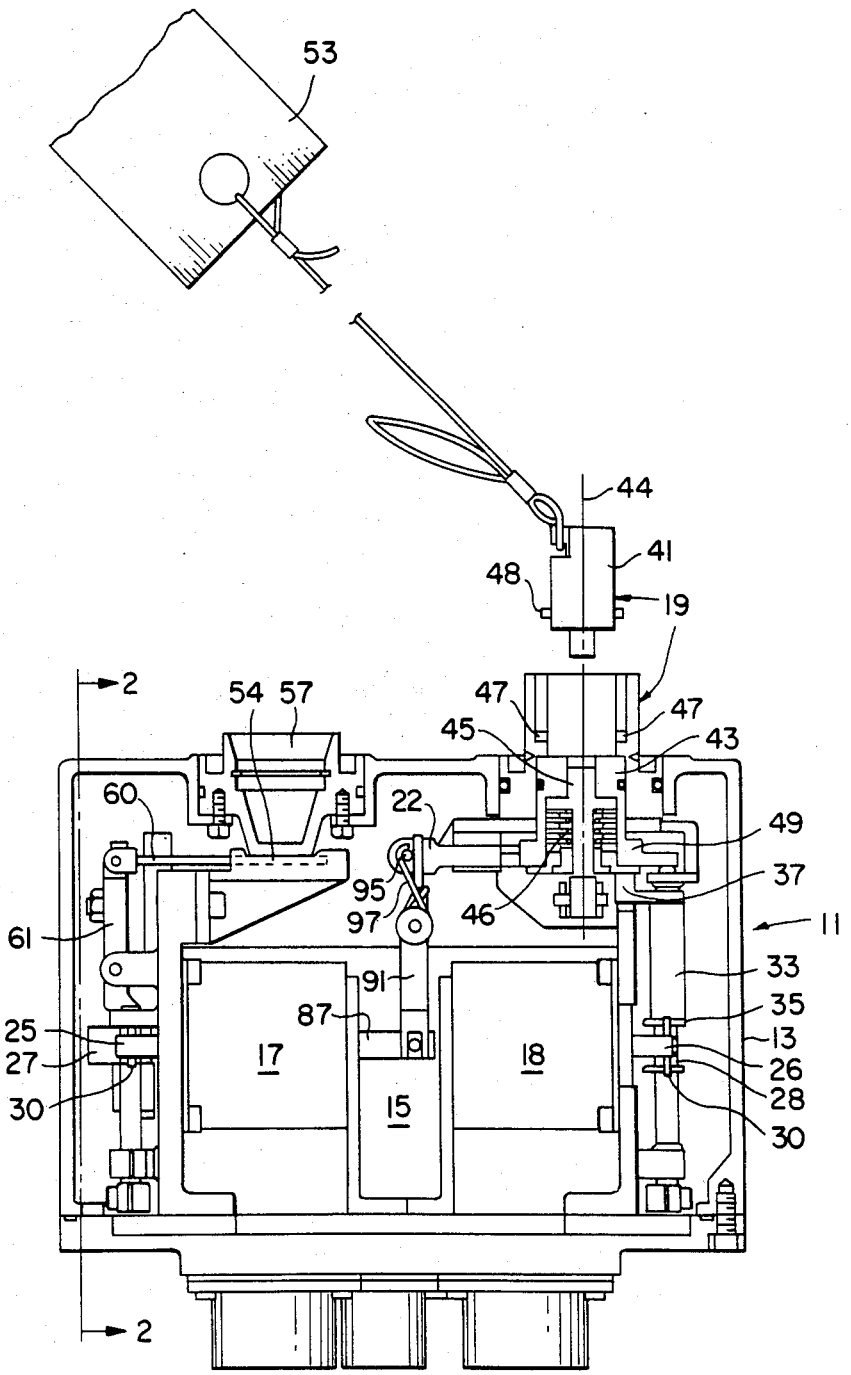
FIG. 1 is a partially cut-away view of a switch assembly constructed in accordance with the preferred embodiment of the invention, showing the actuation mechanism.
Figure 2:
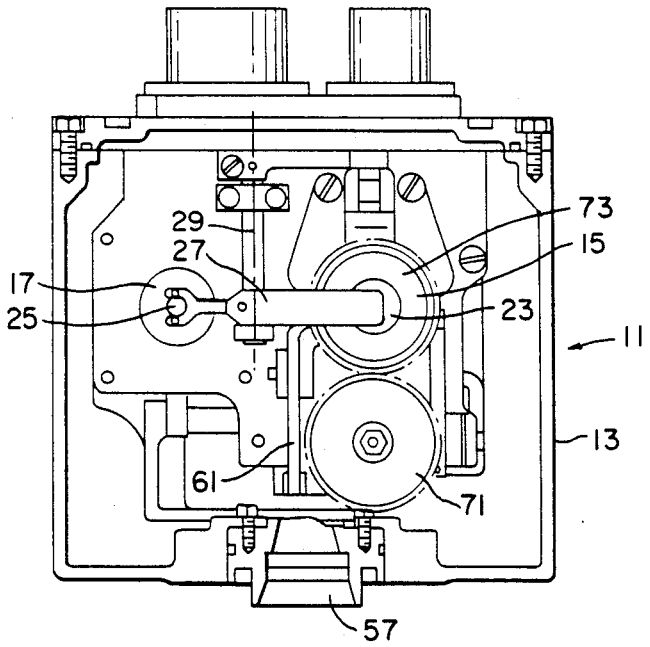
FIG. 2 is a sectional view taken along lines 2—2 of FIG. 1, showing a connection between the actuator mechanism and the switch in an end view.

Referring to FIGS. 1 and 2, a switching assembly 11 constructed in accordance with a preferred embodiment of the invention includes a housing 13, a cylindrical sliding switch 15, a pair of solenoid actuators 17, 18 and a manually operated safing mechanism 19. Actuator 17 is an "arming" actuator, meaning that the powering of the "arming" actuator 17 is required to position the switch 15 in an "on" status. Actuator 18 is a "safing" actuator, meaning that powering the "safing" actuator 18 causes the switch 15 to be moved to an "off" status. The "arming" actuator 17 may be overriden by the manually operated safing mechanism 19 which in turn, can be locked into its overriding position by a catch 22. The switch 15 has an armature 23 which is reciprocated to change between "off" and "on" statuses. The actuators 17, 18 each have plungers 25, 26, respectively, which move in response to powering of the actuators 17, 18. As viewed in FIG. 1, the "arming" actuator's plunger 25 moves to the left when actuated and the "safing" actuator's plunger 26 moves to the right when actuated. A pair of links 27, 28 are used to connect the plungers 25, 26 to the switch armature 23. The links 27, 28 are directly connected to their respective plungers 25, 26 by pins 30. No connection between the links 27, 28 and the armature 23 is provided. The links 27, 28 effect mechanical operation of the switch 15 by pressing the switch's armature 23 from the end of the armature 23 in a direction parallel to the movement of the armature 23. The links 27, 28 are positioned to have a clearance of 3.5 mm (0.140") each with respect to the armature 23, for a collective clearance of 7 mm.

Referring to FIG. 1, a pivot rod 33 is connected to a manually operated safing mechanism 19 and link 28, associated with the "safing" actuator 18. The connection to link 28 is effected via a short link 35, which is connected to the "safing" actuator's plunger 26 by means of its pin 30. The pivot rod 33, and consequently the short link 35, pivot long the same axis as link 28. Pivot rod 33 is caused to pivot by the movement of the "safing" plunger 26 and by a cam follower 37. Whenever the cam follower 37 is moved, causing the pivot rod 33 to move, the "safing" plunger is also forced to move.

The manually operated "safing" mechanism 19 includes a specialized drive tool 41 and a rotary assembly 43, both of which rotate along axis 44. A plunger 45, biased by a spring 46 is depressed whenever the specialized drive tool 41 is inserted into the rotary assembly 43. A pair of slots 47 made with cooperating pins 48 retain the specialized drive tool 41 in position against the plunger 45 whenever the rotary assembly 43 and tool 41 are turned to the overriding position. In the overriding position, a lower extension 49 of the rotary assembly 43 engages the cam follower 37, forcing the "safing" plunger 26 to a position which it would hold when the "safing" actuator 18 is powered. The rotary assembly 43 cannot be rotated in such a way as to force the pivot rod 33 to disengage the "safing" actuator 18. The specialized drive tool 41 has a streamer 53 attached thereto in order to discourage people from attempting to operate equipment, such as a vehicle associated with the switch assembly 11, when the manually operated safing mechanism 19 is in engagement with the cam follower 37.

By providing an appropriate slot (not shown) in the lower extension 49, the cam follower can be used to provide a detent at the overriding and at the disengaged positions.

Referring to FIGS. 1 and 2, a flag 54 is located adjacent a viewing sight 57 and indicates whether the switch 15 is in the "on" or "off" status. The flag 54 is connected by a rod 60, a lever 61 and a second rod (not shown) to the switch's armature 23. The position of the flag 54, therefore, corresponds to the position of the armature 23, indicating the status of the switch 15. The flag 54 is preferably marked with appropriate colored markings so that the status of the switch 15 may be checked by viewing the flag 54 through the viewing sight 57.

Figure 3:
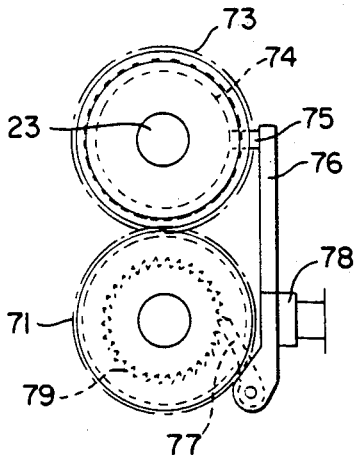
FIG. 3 shows a ratchet mechanism used in the switching assembly of FIGS. 1 and 2.

Referring to FIGS. 2 and 3, a ratcheting wheel 71 and a driven wheel 73 are used to effect rotation of the armature 23 every time the armature 23 is reciprocated. The driven wheel has a groove 74 cut from its perimeter, and a follower 75 rides in the groove 74. The follower 75 is attached to an arm 76. When the armature 23 reciprocates, the driven wheel 73 travels with it, causing the arm 76 to pivot about a pivot 78. This causes a pawl 77 to move against a ratchet 79 fixed to the ratcheting wheel 71. The ratcheting wheel 71, thus rotated, rotates the driven wheel 73 in the opposite direction whenever the armature 23 moves toward the "on" status. The armature 23, being fixed to the driven wheel 73, and thus rotates with it.

The "arming" plunger 25 has an extension 87 which extends in the direction of the "safing" actuator 18 and has attached thereto a lock-out link 91. The catch 22 is aligned with the lock-out link 91. As viewed in FIG. 1, movement of the "arming" plunger 25 to the right (power off, normal position) causes the lock-out link 91 to force the catch 22 to the left by means of a catch pin 95.

A spring 97 biases the catch 22 to the right as viewed in FIG. 1, when the "arming" solenoid 71 is powered. The catch 22 fits into a slot (not shown) on the rotary assembly 43 of the manually operated safing mechanism 19. The slot is positioned so that it lines up with the catch 22 whenever the rotary assembly 43 is turned to a "safe" position. If the "arming" solenoid 17 is powered at any time when the rotary assembly 43 is in the "safe" position, the catch 22 will drop into the slot due to bias by the spring 97, thus acting as a holding latch to prevent the rotary assembly 43 from being counter-rotated away from the "safe" position. As a result, the specialized drive tool 41, with its streamer 53, is prevented from being removed.

The ability of the "arming" plunger 25 to move sufficiently to allow the catch 22 to fit into the slot is made possible by the 3.5 mm clearance between link 27 and the armature 23. For this reason, even though the locked position of the rotary assembly 43 prevents the armature 23 from being moved to an "on" position, the "arming" plunger 25 can be moved sufficiently to allow the catch 22 to engage its slot.

Figure 4:
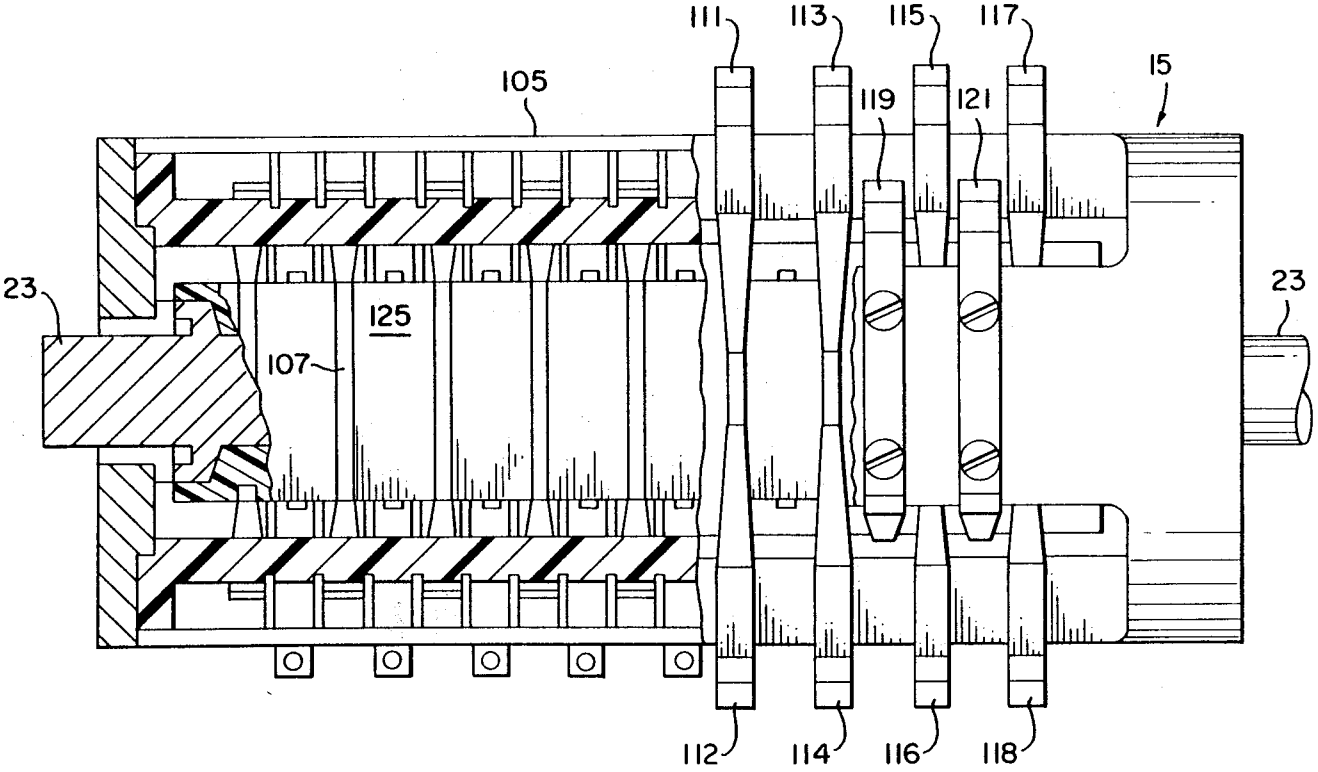
FIG. 4 shows a partially sectioned view of the switch used in the switching assembly of FIGS. 1 and 2.

Referring to FIG. 4, the switch 15 includes the reciprocating armature 23 and a housing 105. The armature 23 has a plurality of shorting bars 107 thereon, which connect contact leaves 111–121 which are arranged in aligned pairs 111, 112 typical. The shorting rings 107 are inserted into a dielectric insulating material 125 and are preferably made from a noble metal. The contact leaves 111–121 are preferably made of a resilient material such as a copper alloy known in the trade as "beryllium copper alloy 25". The contact leaves 111–121 have contact buttons (not shown) which brush the shorting bars 107 and are preferably made of a noble metal alloy, such as silver cadmium oxide or a gold alloy, the exact choice being dependent on whether the particular contact button is used for high current or as part of a low impedance circuit carrying low current levels.

As stated supra, because the driven gear 73 rotates upon reciprocation, the armature 23 is also rotated. The armature 23, containing the shorting bars 107, has a circular cross-section. Therefore, upon rotation of the armature 23, different parts of the shorting bars 107 are contacted by the contacts 111–121. This limited controlled rotation distributes the wear on the shorting bars 107 along the outer circumference of the shorting bars 107, thereby presenting a clean contact area for each current application, resulting in an extremely low contact resistance.

While the specific features in the preferred embodiment have been described, it is possible to implement the inventive conceps herein by different means. For this reason, the present invention should be read as limited only by the appended claims.

What is claimed is:

1. Switching assembly having at least one make-or-break connection, which is switchable between a first status and a second status in response to electrical signals, characterized by:

(a) solenoid means providing force in response to the electrical signals;

(b) a moveable switch armature, the status of the make-or-break connection being controlled by movement of the switch armature, the armature being connected to the solenoid means so that the force from the solenoid biases the armature to effect said movement when the solenoid responds to said electrical signals; and (c) a manually operated override assembly, connected to at least one of either the switch armature or the solenoid means so as to force the switch armature to a "safed" position in which the make-or-break connection is in the first status, the manually operated override means providing a force which is sufficient to overcome the biasing force exerted by the solenoid means;

(d) means to latch the manually operated override assembly in the "safed" position when the solenoid means applied force to bias the switch armature to the second status, the latching means including:

(i) a catch, (ii) an opening in the manually operated override assembly, adapted to receive the catch, said opening being juxtaposed with the catch when the manually operated override assembly is in the "safed" position, and (iii) catch biasing means, the catch biasing means biasing the catch into engagement with said opening to latch the manually operated override assembly into the "safed" position whenever the solenoid means applies the force to the bias the switch armature to the second state, so that the armature is unable to fully respond to said biasing.

2. Apparatus as described in claim 1, further characterized by the latching means including:

(a) a catch;

(b) an opening in the manually operated override assembly, adapted to receive the catch, said opening being juxtaposed with the catch when the manually operated override assembly is in the "safed" position; and (c) catch biasing means, the catch biasing means biasing the catch into engagement with said opening to latch the manually operated override assembly into the "safed" position whenever the solenoid means applies the force to the bias the armature to the second state, so that the armature is unable to fully respond to said biasing.

3. Apparatus as described in claim 1, further characterized by:

a clearance being provided between the solenoid means and the armature so that the solenoid means may move the catch biasing means when the solenoid means is responding to the electrical signals so as to bias the armature to the position where the make-or-break connection is in the second status.

4. Apparatus as described in claim 1, further characterized by the manually operated override means including:

(a) a specialized tool; and (b) means to retain the specialized tool within the switching assembly whenever the manually operated override assembly is in the "safed" position.

5. Apparatus as described in claim 4, further characterized by:

the manually operated override means including means to bias the specialized tool away from a state of engagement with the remaining manually operated override means, thereby causing the specialized tool to be ejected from the switching assembly when the manually operated override assembly is not in the "safed" position.

6. Switching assembly having at least one make-or-break connection, which is switchable between a first status and a second status in response to electrical signals, characterized by:

(a) solenoid means providing force in response to the electrical signals;

(b) a moveable switch armature, the status of the make-or-break connection being controlled by reciprocal movement of the switch armature, the armature being connected to the solenoid means so that force from the solenoid biases the armature in order to effect that reciprocating movement when the solenoid responds to said electrical signals;

(c) means to rotate the armature in response to said reciprocal movement;

(d) the armature having a cylindrical portion;

(e) a plurality of contact members establishing said make-or-break connection with at least one shorting bar and juxtaposed to the cylindrical portion; and (f) the cylindrical portion including a dielectric surface interrupted by said shorting bar, the shorting bar being substantially flush with the outer surface of the cylindrical portion and extending around the cylindrical portion so that the shorting bar's outer circumference has a substantially circular cross-section.

7. Apparatus as described in claim 6, further characterized by:

means to latch the manually operated override assembly in the first status when the solenoid means applies force to bias the armature to the second status.

8. Apparatus as described in claim 6, further characterized by:

a manually operated override assembly, connected to at least one of the armature and the solenoid means as to maintain the switch armature in the first status, regardless of the biasing force exerted by the solenoid means.

* * * * *